US009206820B2

(12) United States Patent
Subbaraman et al.

(10) Patent No.: US 9,206,820 B2
(45) Date of Patent: Dec. 8, 2015

(54) INDUCER WITH CAVITATION INSTABILITY CONTROLS TO REDUCE VIBRATIONS AND RADIAL LOADS

(75) Inventors: Maria Romaniuk Subbaraman, Bell Canyon, CA (US); Saleh Tyzoon Tyebjee, Oakland, CA (US)

(73) Assignee: AEROJET ROCKETDYNE, INC., Rancho Cordova, CA (US)

( * ) Notice: Subject to any disclaimer, the term of this patent is extended or adjusted under 35 U.S.C. 154(b) by 625 days.

(21) Appl. No.: 13/493,554

(22) Filed: Jun. 11, 2012

(65) Prior Publication Data

US 2013/0330185 A1 Dec. 12, 2013

(51) Int. Cl.

| | |
|---|---|
| ***F01D 5/22*** | (2006.01) |
| ***F04D 29/68*** | (2006.01) |
| ***F04D 29/22*** | (2006.01) |

(52) U.S. Cl.

CPC ..... *F04D 29/688* (2013.01); *F04D 29/2277* (2013.01)

(58) Field of Classification Search

CPC ..... F04D 3/02; F04D 29/688; F04D 29/2277
USPC ..... 415/72, 73, 189, 77; 416/176, 177, 175, 416/189, 203
See application file for complete search history.

(56) References Cited

U.S. PATENT DOCUMENTS

| | | | | |
|---|---|---|---|---|
| 3,103,176 | A | 9/1963 | Lang et al. | |
| 3,200,753 | A | 8/1965 | Di Stefano et. al. | |
| 4,155,684 | A | 5/1979 | Curiel et al. | |
| 4,589,253 | A | 5/1986 | Wagner | |
| 4,642,023 | A | 2/1987 | Dunn | |
| 4,708,584 | A | 11/1987 | Meng | |
| 5,074,762 | A | 12/1991 | Mechin | |
| 5,077,968 | A | 1/1992 | Branstrom | |
| 5,156,534 | A | 10/1992 | Burgy et al. | |
| 5,197,851 | A | 3/1993 | Girault | |
| 5,224,817 | A | 7/1993 | Girault | |
| 5,551,230 | A | 9/1996 | Meng | |
| 7,070,388 | B2 | 7/2006 | Meng et al. | |
| 7,870,731 | B2 * | 1/2011 | Fledersbacher et al. | 60/605.1 |
| 7,931,441 | B1 | 4/2011 | Pinera et al. | |
| 8,622,706 | B2 * | 1/2014 | Burgess et al. | 416/185 |
| 2009/0169374 | A1 * | 7/2009 | Ilves et al. | 415/206 |

* cited by examiner

*Primary Examiner* — Dwayne J White
*Assistant Examiner* — Jason Fountain
(74) *Attorney, Agent, or Firm* — Joel G Landau

(57) ABSTRACT

An inducer includes a hub having an inlet end and an outlet end. At least one full size blade has an inner edge is affixed to the hub and an outer edge. This full size blade extends rearwardly from the inlet end in a helical configuration. A partial shroud encloses a first length of the full size blade outer edge adjacent the inlet end. A second length of the full size blade outer edge that is adjacent to the outlet end is free of the partial shroud. It is within the scope of the disclosure to include short blades symmetrically offset from the two full size blades. These short blades have a short blade inner end affixed to the partial shroud and a short blade outer end extending from the partial shroud towards the hub, but terminating prior to reaching the hub.

11 Claims, 6 Drawing Sheets

INDUCER WITH CAVITATION INSTABILITY CONTROLS TO REDUCE VIBRATIONS AND RADIAL LOADS

CROSS REFERENCE TO RELATED APPLICATION(S)

N.A.

U.S. GOVERNMENT RIGHTS

N.A.

BACKGROUND

1. Field

The disclosure herein relates to an inducer employed to increase the pressure of a liquid introduced to a pump. More particularly, the inducer increases the pressure of a liquid propellant being pumped to the combustion chamber of a rocket engine.

2. Description of the Related Art

Liquid fuel rocket engines typically include tanks containing a liquid oxidizer, such as liquid oxygen, and a liquid fuel, such as liquid hydrogen, collectively called propellants. To reduce the thickness of the tanks and their associated weight, the liquid propellants are usually at a relatively low pressure. The liquid propellants are pumped to a combustion chamber and then ignited to generate thrust. To achieve sufficient thrust, the liquid propellants must be sufficiently pressurized prior to introduction to the combustion chamber. A pump, such as a turbopump, is used to pressurize the liquid propellants. As a first step, an inducer may be located between the propellant tanks and the turbopump to produce an initial pressure increase.

The inducer is an axial flow pumping device, typically a first element of low weight, high performance pumps, for use in liquid propulsion rocket engines. The inducer receives the liquid propellant at a very low inlet pressure and provides sufficient discharge pressure for the next pump stage, usually a radial impeller, to operate safely at high shaft speeds. The inducer must achieve satisfactory discharge pressure at the inducer exit with extremely low pressure at the inlet. The inducer includes a number of rapidly spinning blades to draw the liquid propellant through the inducer. Vortices tend to form on the tips of the blades causing cavitation damage to the blades and a variety of vibrations associated with vortex cavitation instabilities that may be detrimental to the engine operability or life.

It is known that enclosing the tips of the blades in a shroud eliminates the formation of vortices. For example, U.S. Pat. No. 4,642,023 entitled "Vented Shrouded Inducer," discloses a shroud with a series of holes that allows counterflowing fluid around the outside of the shroud to flow back into the impeller. U.S. Pat. No. 7,070,388, entitled "Inducer with Shrouded Rotor for High Speed Applications," discloses an inducer rotor with rotor blades terminating at a shroud. The shroud has a variable thickness both to reduce weight and to maintain a uniform gap between the shroud and a housing wall during high speed rotation. U.S. Pat. No. 7,931,441, entitled "Inducer with Tip Shroud and Turbine Blades," discloses an inducer with two sets of blades arranged axially one after the other. The upstream blades are full size and the downstream blades are half size. The downstream half size blade tips are enclosed in a shroud.

U.S. Pat. Nos. 4,642,023; 7,070,388 and 7,931,441 are incorporated by reference herein in their entireties.

At high rotating speeds, even shrouded blades are subject to a manifestation of cavitation-related hydrodynamic phenomena, including the type referred to as alternate blade cavitation. Alternate blade cavitation manifests as long and short vapor cavities on alternate blades. When there are only two blades, alternate blade cavitation is inherently asymmetric, with a short cavity on one blade and a long cavity on the other blade, resulting in radial load imbalance. A symmetric pattern is only possible with an even number of at least four inducer blades (e.g. 6 or 8 blades also achieve symmetry). Four bladed inducers are utilized in many present day rocket engines. In a four bladed inducer, alternate blade cavitation is characterized by a stable pattern of two large cavities on one opposing pair of blades and two small cavities on the other pair of opposing blades. Such stable patterns result in low radial loads beneficial to bearing life and do not generate traveling pressure instabilities or adverse system vibrations.

However, ultra high suction capability requires a very low inlet flow coefficient (very low ratio of axial inlet velocity to blade tip speed), which in turn requires very low blade angles with respect to the tangential direction, producing a high degree of fluid flow blockage. Higher blade counts exacerbate the blockage problem at low blade angles.

There remains a need for an inducer having the fluid flow capacity of a two or three blade configuration and the cavitation stability of a four blade configuration.

BRIEF SUMMARY

In accordance with a first embodiment of the disclosure, an inducer includes a hub having an inlet end and an outlet end. At least one full size blade has an inner edge affixed to the hub and an outer edge. This full size blade extends rearwardly from the inlet end in a helical configuration. A partial shroud encloses a first length of the full size blade outer edge adjacent the inlet end. A second length of the full size blade outer edge that is adjacent to the outlet end is free of the partial shroud.

One feature of this embodiment is that the inducer has a low number of full size blades and preferably has two full size blades, offset by 180°, symmetrically disposed about the hub.

Another feature of an inducer with the partial shroud embodiments is that, unlike a fully shrouded low flow-coefficient inducer, this inducer is machinable in one piece, which lowers fabrication cost and preserves dimensional accuracy.

In accordance with a second embodiment, the inducer of the first embodiment further includes short blades symmetrically offset from the two full size blades. These short blades have a short blade inner end affixed to the partial shroud and a short blade outer end extending from the partial shroud towards the hub, but terminating prior to reaching the hub.

Alternatives of this second embodiment include the short partial blades having an inner end affixed to the inducer hub and an outer end terminating before the radius of the full size blade is reached and where there are two sets of partial blades, one set attached to the hub and the other set attached to the shroud.

The details of one or more embodiments of the invention are set forth in the accompanying drawings and the description below. Other features, objects and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
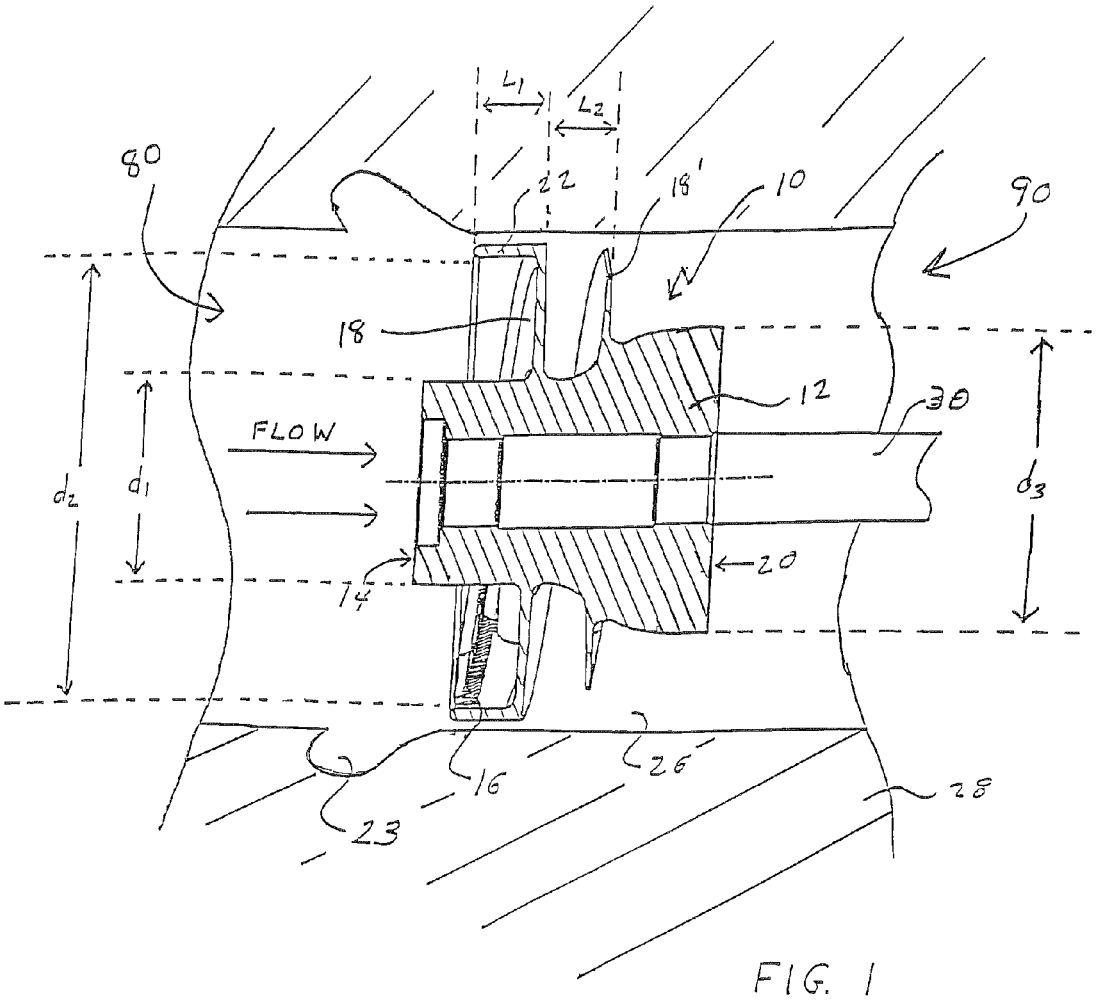
FIG. 1 illustrates in cross-sectional representation a partially shrouded inducer in accordance with a first embodiment disclosed herein.

FIG. 1 illustrates a first embodiment of an inducer 10 having ultra-high suction performance effective to enable operation of an upper stage pump-fed engine at low inlet pressures and low pressure margins from propellant vapor pressure over a wide range of flowrates, thereby reducing the overall system weight and facilitating more complete propellant utilization. Inducer 10 has a cylindrical-symmetry hub 12 formed by either a straight line (resulting in a cylindrical or conical hub) or a polynomial. An upstream, inlet hub face 14 has a diameter, $d_1$, that is from 30% to 50% the diameter, $d_2$, of the tips 16 of full size inducer blades 18. The inducer 10 terminates at a downstream, discharge hub face 20 that has a diameter, $d_3$, that is equal to or larger than the diameter, $d_1$, of the inlet hub face 14.

Figure 2A:
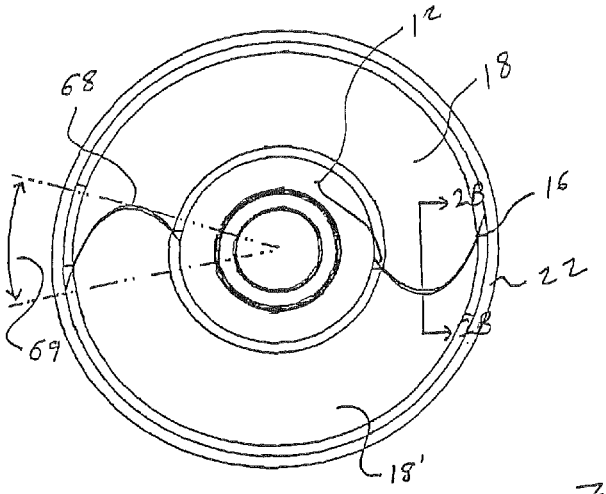
FIG. 2A is a frontal view of the inlet face of the inducer of FIG. 1.

With reference to FIG. 2A, the full size inducer blades 18 extend from the hub 12 to a partial shroud 22. There are preferably at least two full size inducer blades 18. To minimize fluid flow blockage, two or three full size inducer blades symmetrically disposed around the hub 12 are most preferred. The full size inducer blades are backwards swept at the hub 12 and forward swept at the tip 16, resulting in the leading edge contour, also referred to as the "sweep," that has a shape similar to the letter "C". In a polar coordinate system, with Z being the axis of rotation, theta (Θ) being the blade wrap angle defined as positive in the direction of rotation, and zero theta being at the position where the leading edge of the blade meets the hub, blade sweep is the 0 position along the leading edge of the blade. Typically, a blade has forward sweep if the leading edge of the blade at the tip is at a positive Θ position. Inducer 10 has a variable sweep leading edge 68. Typically, for a shrouded and forward swept inducer, the angular depth 69 of the minimum sweep is achieved between 5% and 50% span from the hub 12 and is between 0° and −45°. The forward-swept leading edge 68 controls the effective incidence angle distribution and limits the volume of incidence driven sheet cavitation.

Figure 2B:
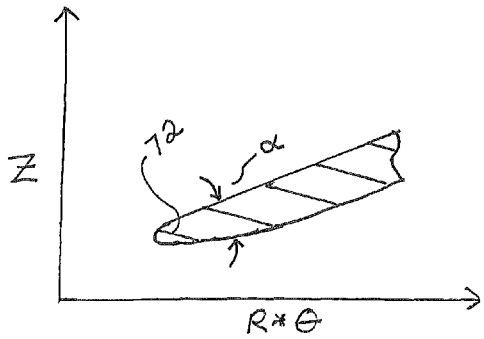
FIG. 2B is a cross-sectional view of the full size blades of FIG. 2A at the leading edge showing the leading edge wedge angle.

With reference to FIG. 2B, when viewed along the Z axis, the full size inducer blade 18 has a leading edge wedge 72 profiled for cavitation control. Typically, the leading edge wedge angle, α, is between 3° and 7° in the R*Θ−Z plane.

Figure 3:
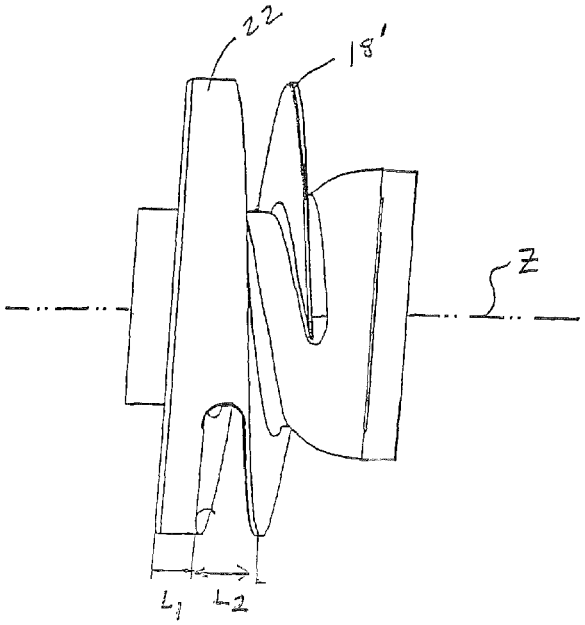
FIG. 3 is a side perspective view of the inducer of FIG. 1 illustrating the helical shape of an inducer blade, although the blade angle can vary from the leading edge to the trailing edge.

Referring to FIGS. 1 and 3, the partial shroud 22 is a variable axial length cylindrical shroud that encloses the tips 16 of the full size inducer blades 18 for a first axial length, $L_1$, corresponding to about 180° wrap, that begins adjacent the inlet hub face 14 and extends towards the discharge hub face 20, terminating prior to the end of the full size inducer blades 18' such that a second length, $L_2$, of the blades is free of the partial shroud 22 and has a blade tip diameter matching the outer diameter of the partial shroud. $L_1$ extending past the throat or terminating just before the throat is acceptable. The operating flow coefficient is between 0.02 and 0.05, the lowest practical range achievable when taking into account blade blockage of a two bladed inducer using existing material of construction.

Figure 5:
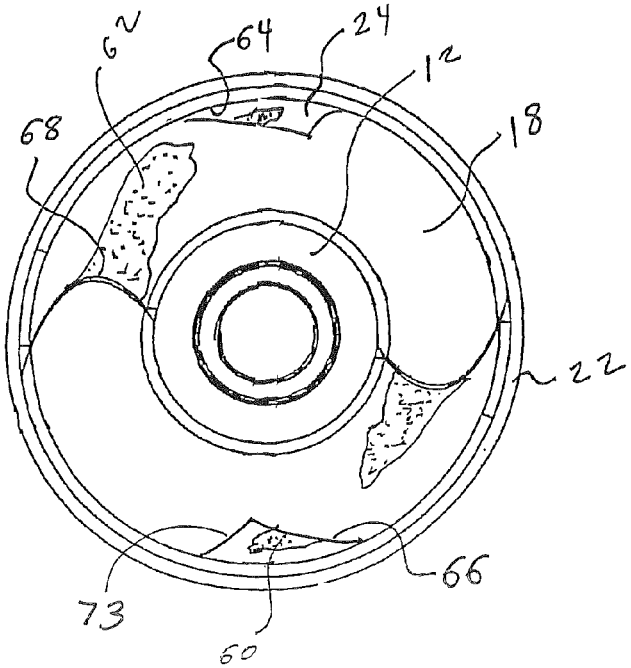
FIG. 5 is a frontal view of the inlet face of an inducer having both full blades and partial blades in accordance with a second embodiment disclosed herein.

The full size inducer blades 18 have a blade length $L_1+L_2$, as determined by the total wrap angle at the tip 16, effective to insure tip solidity of at least 1.5, where tip solidity is the ratio of the blade chord length along the tip and the circumferential spacing between blades at discharge. As illustrated in FIG. 5, in accordance with a second embodiment, short inducer blades 24 are symmetrically offset from the full size inducer blades 18.

Referring back to FIG. 1, the inducer 10 is mounted on a shaft 30 within a pump housing 28, such as a turbopump used to transfer a liquid propellant to a combustion chamber of a rocket. A shaft 30 rotated, such as by a turbine, rotates the inducer 10, typically at a rotational speed of between 0 rpm and 100,000 rpm. As a result, liquid propellant enters the inducer at the inlet 80 at a relatively low pressure, nominally with some positive margin from the propellant vapor pressure, and exits the discharge 90 at a considerably higher pressure, nominally that of a head coefficient ranging from 0.05 to 0.4, where the head coefficient is the inducer pressure rise normalized with the inducer dynamic pressure based on tip speed.

The partial shroud described herein eliminates tip vortex cavitation and associated vibrations while limiting the length and weight of the shroud to the minimum necessary to accomplish this specific objective without the deleterious effects of a traditional full shroud. The partial shroud may also support the partial blades (reference number 24 in FIG. 5) disclosed below.

Figure 4:
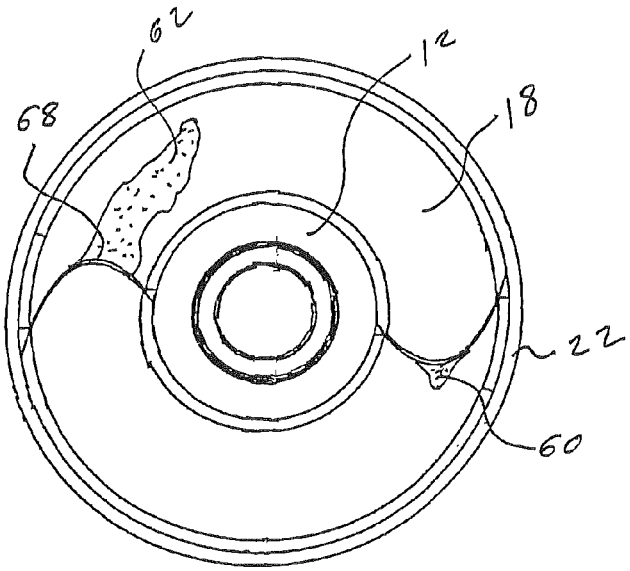
FIG. 4 is a frontal view of an inlet face of an inducer illustrating alternate blade cavitation.
Figure 6:
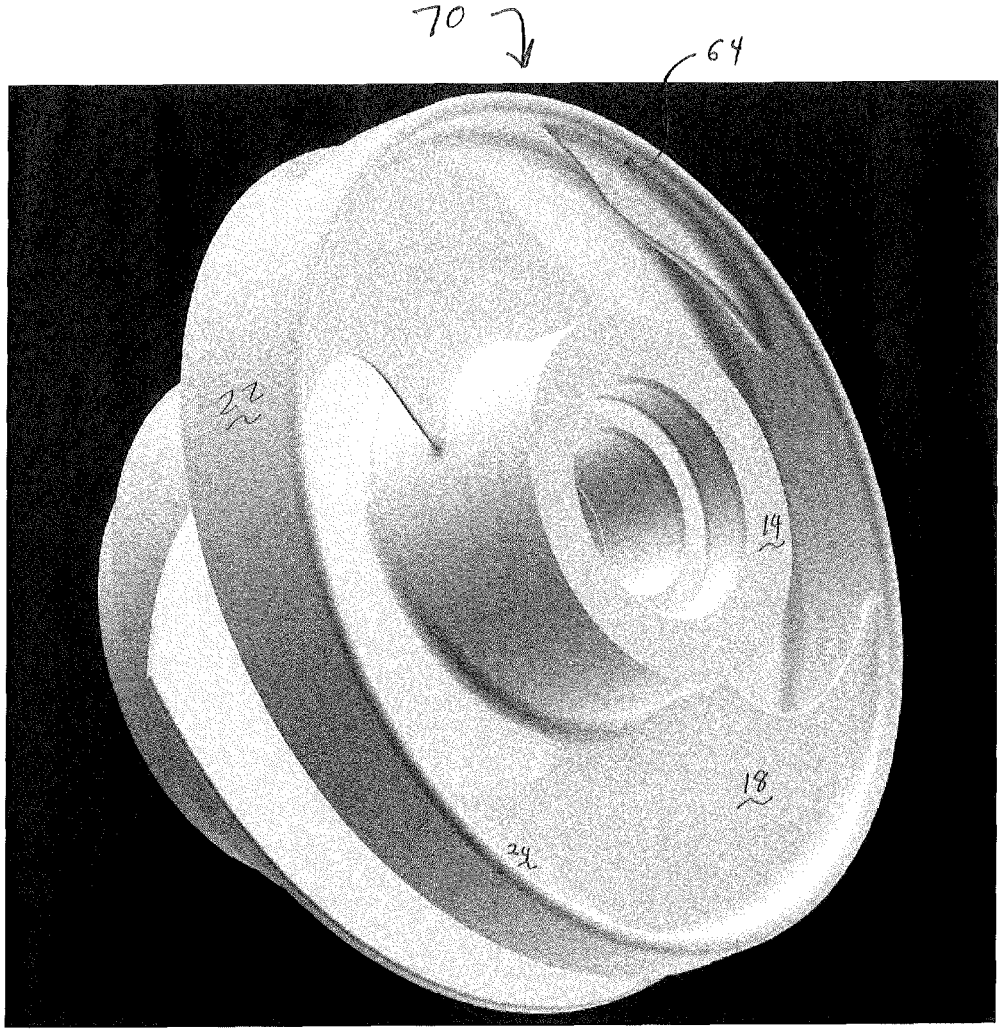
FIG. 6 is a frontal/side perspective view of the inducer of FIG. 5.

FIG. 4 illustrates alternate blade cavitation in a two-blade inducer as discussed above. A short cavity 60 has formed on one blade and a long cavity 62 has formed on the other blade. The unbalanced blades may lead to adverse radial forces reducing bearing life. In accordance with a second embodiment, FIGS. 5 and 6 illustrate a pair of short inducer blades 24 offset by 90° from the full size inducer blades 18. The benefit of a two blade system, lower blade blockage enabling design for a very low inlet flow coefficient, is combined with the benefits of a four blade system, with symmetric and thus balanced alternate blade cavitation. The problem of radial loads due to asymmetric alternate blade cavitation in a two bladed inducer is thus overcome by introducing two short partial blades 24 at the inlet face 14 adjacent the partial shroud 22.

It is believed that the two short partial blades 24 provide sites for two short cavities 60 to form allowing the two full size inducer blades 18 to develop two stable, long cavities 62. As a result, the two bladed inducer 70 with short partial blades functions as a four bladed inducer with respect to alternate blade cavitation, with the associated benefit of low radial load. The partial short inducer blades 24 only span a fraction of the full blade height. The size of the short partial blade 24 is the minimum necessary to provide a site for sheet cavity stabilization and is typically from 5% to 75% of the full blade height and causes a negligible blade blockage compared to an inducer with four full blades. It is further believed that the partial short inducer blades 24 alternating with full size blades 18 will encourage formation of a benign alternate blade cavitation pattern over a wider range of operating conditions than is observed with conventional four bladed inducers, thereby curtailing the range over which an undesirable rotating cavitation exists. This rotating cavitation phenomenon is linked to inlet pressure oscillations and system vibrations, and is particularly prevalent in 3-bladed inducers.

Partial blades in 3-bladed inducers are expected to convert the undesirable rotating cavitation to the benign alternate blade cavitation resembling that of a 6-bladed inducer, without the excessive blade blockage of the full six blades.

The short partial blade 24 is supported only at the shroud 22 by a fillet 64 (not visible) and has a length smaller, equal to or greater than its height. The leading edge 66 of this short partial blade 24 can be profiled to match the leading edge 68 of the full size blade 18, or may be deliberately different in thickness and blade angle. The trailing edge 73 of the short partial blade 24 is profiled to prevent vibrations by using large enough fillets and blade thickness.

The short partial blades 24 may be cast or machined integral with the shroud or attached, such as by brazing, welding, screwing or riveting.

Figure 7:
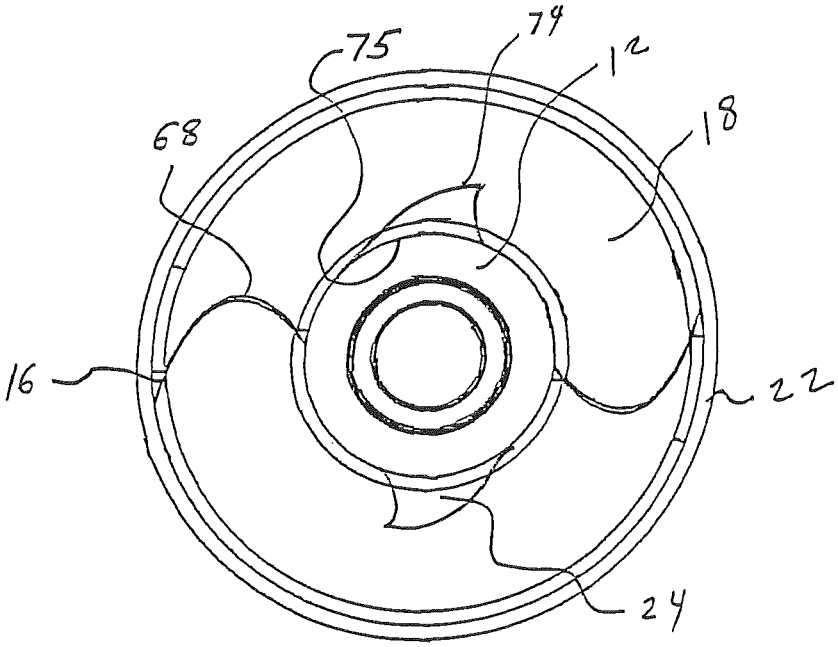
FIG. 7 is a frontal view of the inlet face of an inducer having full blades and partial blades in accordance with a third embodiment disclosed herein.

Alternatively, as shown in FIG. 7, the short partial blades 24 may have an inner end 75 affixed to the inducer hub 12 and an outer end 74 extending toward the tip 16 of a full size blade 18. The outer end 74 terminates before the radius of the full size blade 18 is reached.

Figure 8:
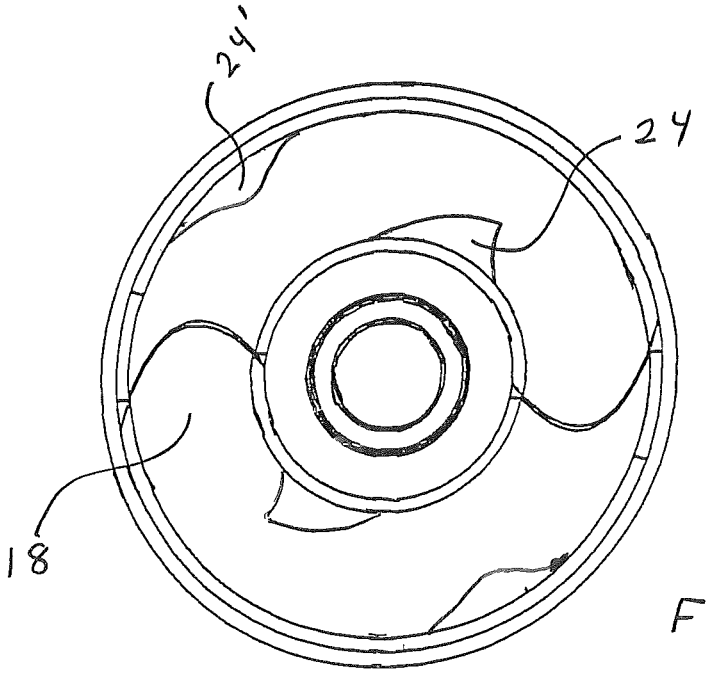
FIG. 8 is a frontal view of the inlet face of an inducer having full blades and two sets of partial blades in accordance with a fourth embodiment disclosed herein.
Figure 9:
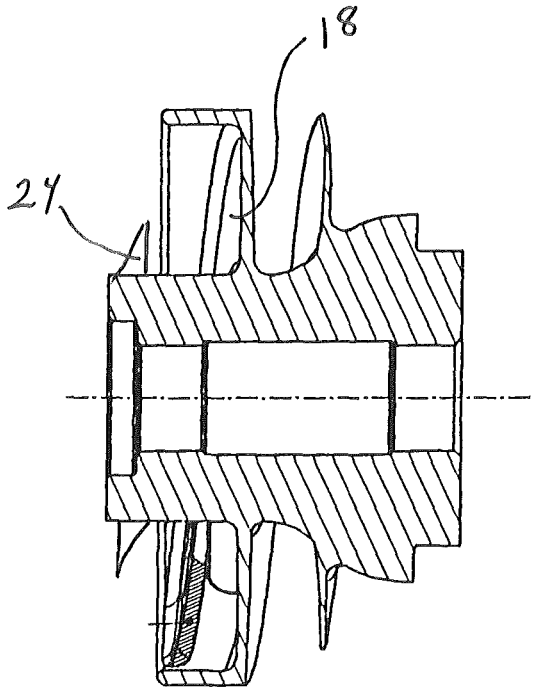
FIG. 9 is a frontal view of the inlet face of an inducer having full blades and partial blades axially offset from the full blades in accordance with a fifth embodiment disclosed herein.

Furthermore, as shown in FIG. 8, two sets of partial blades—one set 24 attached to the hub and the other set 24' attached to the shroud may be used simultaneously, combining the features of the partial blades 24 illustrated in FIG. 6 and FIG. 7. In addition, as shown in FIG. 9, either or both sets of partial blades 24 may be off-set axially from the full size blades 18, preferably in the upstream direction, and one set of partial blades may be off-set circumferentially from the other set.

The front-end partial shroud in combination with a back flow deflector 23 in FIG. 1 will extend the operating range of the inducer down to very low inlet flow rates facilitating a wider overall pump operating range.

One application of the inducer disclosed herein is the Advanced Upper Stage Engine Program (AUSEP). The inducer enables operation of a liquid oxygen turbopump at an inlet net positive suction pressure (NPSP) of below 4 psi. At this value, the engine weight and size are retained within targeted limits. The inducer may also be used in other liquid rocket engines or general pumping applications wherever a very low inlet NPSP or high suction specific speed is required.

One or more embodiments of the present invention have been described. Nevertheless, it will be understood that various modifications may be made without departing from the spirit and scope of the invention. Accordingly, other embodiments are within the scope of the following claims.

What is claimed is:

1. An inducer comprising:

a hub having an inlet end and an outlet end;

at least one full size blade having a full size blade inner edge affixed to said hub and an opposing full size blade outer edge, said full size blade extending rearwardly from said inlet end in a helical configuration;

a partial shroud enclosing a first length of said full size blade outer edge that is adjacent to said inlet end with a second length of said full size blade outer edge that is adjacent to said outlet end being free of said partial shroud; and a first set of short blades symmetrically offset from said full size blades, said first set of short blades having a short blade inner end affixed to said hub and a short blade outer end extending from said hub towards said partial shroud, wherein said first set of short blades is axially offset from said at least one full size blade.

2. An inducer comprising:

a hub having an inlet end and an outlet end;

at least one full size blade having a full size blade inner edge affixed to said hub and an opposing full size blade outer edge, said full size blade extending rearwardly from said inlet end in a helical configuration;

a partial shroud enclosing a first length of said full size blade outer edge that is adjacent to said inlet end with a second length of said full size blade outer edge that is adjacent to said outlet end being free of said partial shroud; and a first set of short blades symmetrically offset from said full size blades, said first set of short blades having a short blade inner end affixed to said hub and a short blade outer end extending from said hub towards said partial shroud, wherein said at least one full size blade and said at least one short blade are circumferentially offset from each other around an axis of rotation of the blades and axially offset from said at least one full size blade.

3. An inducer comprising:

a hub having an inlet end and an outlet end;

at least one full size blade having a full size blade inner edge affixed to said hub and an opposing full size blade outer edge, said full size blade extending rearwardly from said inlet end in a helical configuration;

a partial shroud enclosing a first length of said full size blade outer edge that is adjacent to said inlet end with a second length of said full size blade outer edge that is adjacent to said outlet end being free of said partial shroud;

a first set of short blades symmetrically offset from said full size blades, said first set of short blades having a short blade inner end affixed to said partial shroud and a short blade outer end extending from said partial shroud towards said hub; and a second set of short blades symmetrically offset from said full size blades, said second set of short blades having a short blade inner end affixed to said inducer hub and a short blade outer end extending from said inducer hub towards said inducer outer edge and terminating before a radius of said at least one full size blade is reached, wherein said first set of short blades is axially offset from said at least one full size blade and said second set of short blades is axially aligned with said at least one full size blade.

4. The inducer of claim 3 wherein said at least one full size blade and said first set of short blades are circumferentially offset from each other around the axis of rotation and said second set of short blades is symmetrically disposed with said at least one full size blade.

5. The inducer of claim 3 wherein said at least one full size blade and said first set of short blades are circumferentially offset from each other around the axis of rotation and said second set of short blades is symmetrically disposed with said first set of short blades.

6. The inducer of claim 3 wherein said first set of short blades and said second set of short blades are circumferentially offset from each other and from the said at least one full blade.

7. An inducer comprising:

a hub having an inlet end and an outlet end;

at least one full size blade having a full size blade inner edge affixed to said hub and an opposing full size blade outer edge, said full size blade extending rearwardly from said inlet end in a helical configuration;

a partial shroud enclosing a first length of said full size blade outer edge that is adjacent to said inlet end with a second length of said full size blade outer edge that is adjacent to said outlet end being free of said partial shroud;

a first set of short blades symmetrically offset from said full size blades, said first set of short blades having a short blade inner end affixed to said partial shroud and a short blade outer end extending from said partial shroud towards said hub; and a second set of short blades symmetrically offset from said full size blades, said second set of short blades having a short blade inner end affixed to said inducer hub and a short blade outer end extending from said inducer hub towards said inducer outer edge and terminating before a radius of said at least one full size blade is reached, wherein said at least one full size blade and said first set of short blades are circumferentially offset from each other around the axis of rotation and said second set of short blades is symmetrically disposed with said at least one full size blade.

8. An inducer comprising:

a hub having an inlet end and an outlet end;

at least one full size blade having a full size blade inner edge affixed to said hub and an opposing full size blade outer edge, said full size blade extending rearwardly from said inlet end in a helical configuration;

a partial shroud enclosing a first length of said full size blade outer edge that is adjacent to said inlet end with a second length of said full size blade outer edge that is adjacent to said outlet end being free of said partial shroud;

a first set of short blades symmetrically offset from said full size blades, said first set of short blades having a short blade inner end affixed to said partial shroud and a short blade outer end extending from said partial shroud towards said hub; and a second set of short blades symmetrically offset from said full size blades, said second set of short blades having a short blade inner end affixed to said inducer hub and a short blade outer end extending from said inducer hub towards said inducer outer edge and terminating before a radius of said at least one full size blade is reached, wherein said at least one full size blade and said first set of short blades are circumferentially offset from each other around the axis of rotation and said second set of short blades is symmetrically disposed with said first set of short blades.

9. An inducer comprising:

a hub having an inlet end and an outlet end;

at least one full size blade having a full size blade inner edge affixed to said hub and an opposing full size blade outer edge, said full size blade extending rearwardly from said inlet end in a helical configuration;

a partial shroud enclosing a first length of said full size blade outer edge that is adjacent to said inlet end with a second length of said full size blade outer edge that is adjacent to said outlet end being free of said partial shroud;

a first set of short blades symmetrically offset from said full size blades, said first set of short blades having a short blade inner end affixed to said partial shroud and a short blade outer end extending from said partial shroud towards said hub; and a second set of short blades symmetrically offset from said full size blades, said second set of short blades having a short blade inner end affixed to said inducer hub and a short blade outer end extending from said inducer hub towards said inducer outer edge and terminating before a radius of said at least one full size blade is reached, wherein both said first set of short blades and said second set of short blades are axially offset from said at least one full size blade, wherein said at least one full size blade and said first set of short blades are circumferentially offset from each other around the axis of rotation and said second set of short blades is symmetrically disposed with said at least one full size blade.

10. An inducer comprising:

a hub having an inlet end and an outlet end;

at least one full size blade having a full size blade inner edge affixed to said hub and an opposing full size blade outer edge, said full size blade extending rearwardly from said inlet end in a helical configuration;

a partial shroud enclosing a first length of said full size blade outer edge that is adjacent to said inlet end with a second length of said full size blade outer edge that is adjacent to said outlet end being free of said partial shroud;

a first set of short blades symmetrically offset from said full size blades, said first set of short blades having a short blade inner end affixed to said partial shroud and a short blade outer end extending from said partial shroud towards said hub; and a second set of short blades symmetrically offset from said full size blades, said second set of short blades having a short blade inner end affixed to said inducer hub and a short blade outer end extending from said inducer hub towards said inducer outer edge and terminating before a radius of said at least one full size blade is reached, wherein both said first set of short blades and said second set of short blades are axially offset from said at least one full size blade, wherein said at least one full size blade and said first set of short blades are circumferentially offset from each other around the axis of rotation and said second set of short blades is symmetrically disposed with said first set of short blades.

11. An inducer comprising:

a hub having an inlet end and an outlet end;

at least one full size blade having a full size blade inner edge affixed to said hub and an opposing full size blade outer edge, said full size blade extending rearwardly from said inlet end in a helical configuration; and at least one short blade symmetrically offset from said at least one full size blade, said short blade having a short blade inner end affixed to said inducer hub and a short blade outer end extending from said inducer hub towards said inducer tip and terminating before a radius of said at least one full size blade is reached, wherein said at least one full size blade and said at least one short blade are circumferentially offset from each other around the axis of rotation and axially aligned with each other.

* * * * *